United States Patent [19]

Freeman

[11] 4,279,077

[45] Jul. 21, 1981

[54] POCKET CAN OPENER

[76] Inventor: William L. Freeman, Salt Lake City, Utah

[21] Appl. No.: 141,822

[22] Filed: Apr. 21, 1980

Related U.S. Application Data

[63] Continuation of Ser. No. 938,574, Aug. 31, 1978, abandoned.

[51] Int. Cl.[3] ..... B67B 7/30

[52] U.S. Cl. ..... 30/442; 30/435

[58] Field of Search ..... 30/416, 417, 435, 437, 30/442

[56] References Cited

U.S. PATENT DOCUMENTS

| | | | |
|---|---|---|---|
| 470,710 | 3/1892 | Shay | 30/442 |
| 476,164 | 5/1892 | Newton | 30/442 |
| 496,448 | 5/1893 | Scoville | 30/435 |
| 1,204,992 | 11/1916 | Keller | 30/435 |
| 1,208,500 | 12/1916 | Crites | 30/435 |
| 2,515,362 | 7/1950 | Von Derlieth | 30/435 |

FOREIGN PATENT DOCUMENTS

| | | | |
|---|---|---|---|
| 52909 | 10/1922 | Sweden | 30/435 |

*Primary Examiner*—Gary L. Smith

*Attorney, Agent, or Firm*—Lynn G. Foster

[57] ABSTRACT

A relatively flat and entirely portable can lid removing device comprising can end retaining structure which permits relative rotation of the can and the lid removing device, a can lid cutter which cuts the lid from the remainder of the can during the mentioned relative rotation and creates no sharp edges or burrs in the process, so that the remainder of the can may be used as a container, e.g. a drinking can.

9 Claims, 10 Drawing Figures

POCKET CAN OPENER

CONTINUITY

This application is a continuation of my copending U.S. patent application Ser. No. 938,574, filed Aug. 31, 1978 now abandoned.

BACKGROUND

1. Field of Invention

The present invention relates generally to lid removing devices and more particularly to pocket or portable lid removing devices comprising a thin planar body, a cutting wheel disposed to be substantially parallel or at a slight angle to both the planar body and a lid of the can being cut and which severes the inside circumference of the can lid near the seam thereof leaving no sharp edges or burrs.

2. Prior Art

The prior art is complex and bulky, providing for no pocket storage or portability and no manual precision inside lid cutting. More specifically, U.S. Pat. No. 1,289,645 discloses a complex and bulky can opener comprising a cutter wheel disposed parallel to a can lid which cuts along the outside circumference of the can. Further, U.S. Pat. Nos. 3,216,108; 3,313,023; and 3,348,305 disclose complex and bulky can openers, each comprising a circular cutter disposed parallel to a lid to cut the seam along the inside circumference.

BRIEF SUMMARY AND OBJECTS OF THE INVENTION

A relatively flat and entirely portable lid removing device or can opener comprising a main body with can end retaining structure which permits relative manual rotation of the can and the opener and further including structure accommodating placement of the can end within the removal of the can end from the opener. A sharp cutter wheel is provided for cutting one lid or both lids of a can along the inside circumference while retaining the top seam between the lid and the main cylinder of the can so as to leave no sharp edges or burrs. The tool is particularly useful with aluminum lids.

With the foreging in mind, it is a primary object of the present invention to provide a novel manually operated can lid removing device.

Another important object of the invention is the provision of a simple, relatively flat and entirely portable lid removing device. Another significant object is the provision of a novel manual can opener which may be readily carried in one's pocket, purse, or the like. A further important object of the invention is the provision of a lid removing device which leaves no sharp edges or burrs on the can at the site from which a lid is removed.

An additional object of the invention is the provision of a circular cutting wheel parallel or at a slight angle to the lid which severes the inside circumference of the lid during rotation.

A further object of the invention is to provide for the removal of a lid from a can such that the remainder of the can may be safely used as a container, such as a drinking can. It is another important object to provide a fascile can opener to which one end of the can is inserted and relatively rotatably retained by the can opener so that by holding one of the can or the opener and rotating the other, the adjacent lid will become severed from the can.

These and further objects and features of the invention will become apparent from the foregoing detailed description taken in reference to the accompanying drawings.

DETAILED DESCRIPTION OF THE ILLUSTRATED EMBODIMENTS

Figure 1:
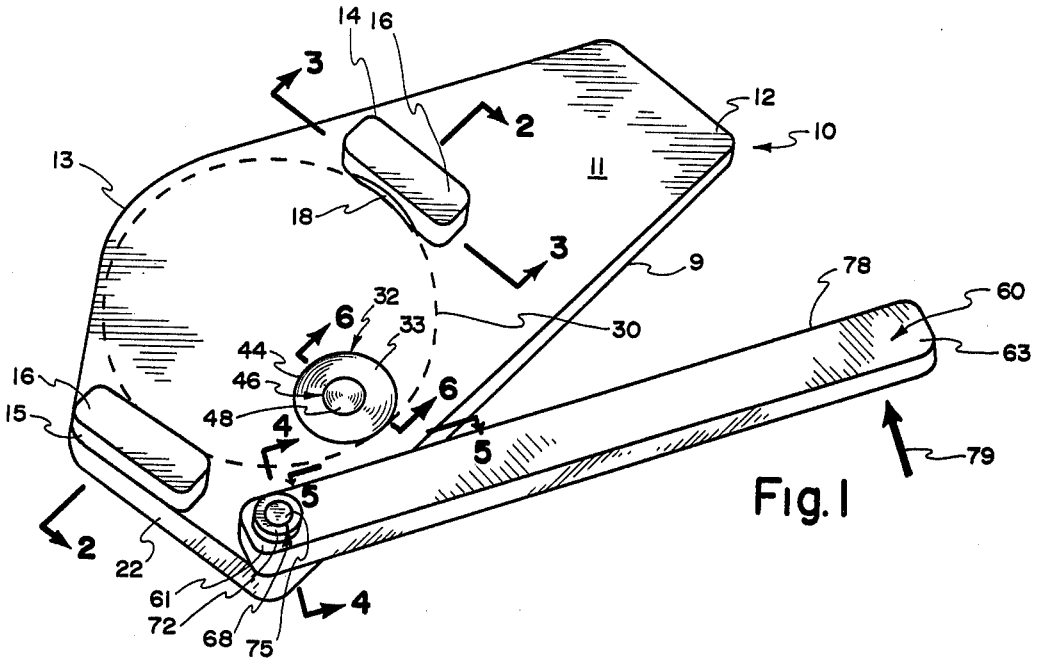
FIG. 1 is an elevated perspective representation of one presently preferred can opener embodiment according to the present invention, showing the opener inverted from its normal orientation when in use.
Figure 2:
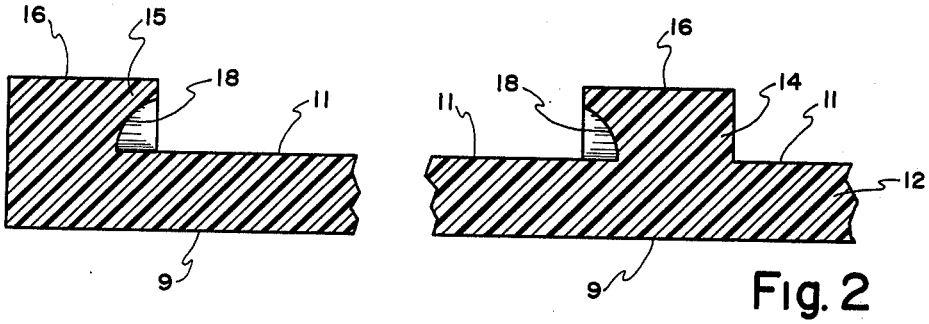
FIG. 2 is a fragmentary cross section taken along line 2—2 of FIG. 1.
Figure 3:
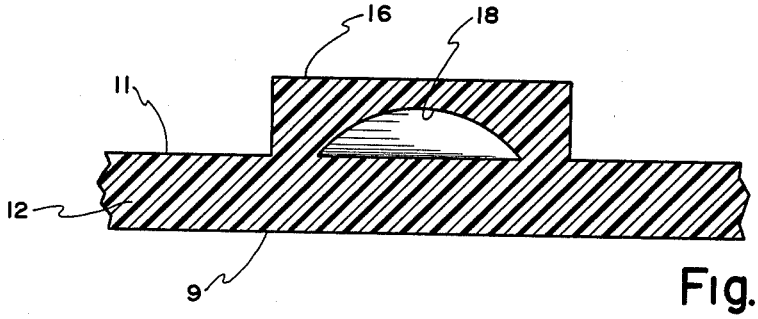
FIG. 3 is a fragmentary cross section taken along line 3—3 of FIG. 1.

Reference is now made to the drawings wherein like numerals are used to designate like parts throughout. FIG. 1, in particular, illustrates a presently preferred can lid removing device, generally designated 10. The orientation of the device 10 in FIG. 1 is inverted in respect to the normal orientation during use. The device 10 comprises a generally flat main body 12 having a flat uninterrupted top surface 9 and a flat bottom surface 11. The body 12 comprises an outwardly projecting widen portion 13 disposed along one longitudinal side.

Figure 7:
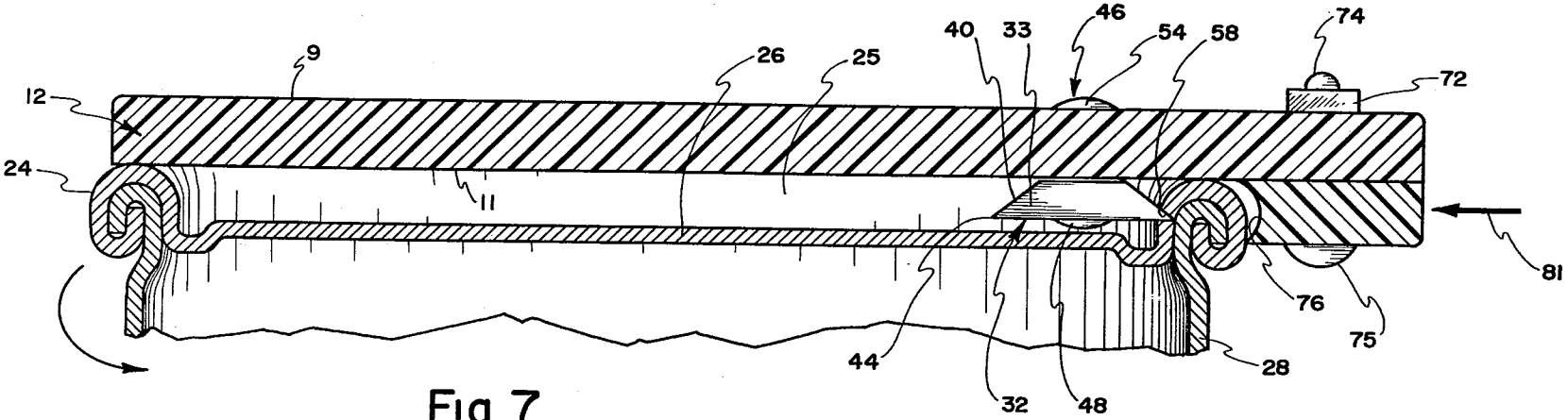
FIG. 7 is a cross section of the can opener of FIG. 1 in its correct orientation illustrating the cutting wheel in the process of cutting a lid from a can along the inside circumference of the lid.

Two opposing thin, though somewhat elevated, stops 14 and 15 are illustrated as being retangular at their exposed bottom surfaces 16. The stops 14 and 15 are integral with the body 12 and project a short distance from the surface 11 more or less perpendicular thereto. Each stop 14 and 15 comprises an arcuate groove 18, which is shaped, contoured and sized to receive part of one end of a hermetically sealed can and to retain the can in rotatable relation within the two grooves 18. The grooves 18 are fashioned and configurated at one end to accommodate essentially rectilinear insertion and removal of the can end, the location of which is shown in dotted lines at site 30 in FIG. 1. This location is also illustrated in FIG. 7, which Figure illustrates the end of the can as well.

More specifically, the can comprises a cylinderical body 28 and a lid 26, with the lid forming a seam or lip 24 with the cylindrical body 28. Because the lid 26, when mounted upon the can cylinder 28 creates a concavity 25 (FIG. 7), ample cutting wheel space is provided. Thus, the lid, using the can lid removing device 10 is caused to be severed along the inside circumference.

The relatively flat body 12 further carries an annular cutting wheel assembly 32. The cutting wheel assembly 32 comprises a cutting wheel 33 rotatably mounted upon a reduced diameter portion 38 of a rivet or other suitable stationary fastner 46. The rivet 46 along its main shank 50 passes snugly through a transverse aperture 52 in the body 12. The rivet is retained by top and bottom enlargements or heads 54 and 48, respectively. Thus, the cutting wheel 33, rotatably riding in the groove 38 of the rivet 46 is allowed to rotate in response to engagement with the lid of the can, as hereinafter more fully explained.

Figure 6:
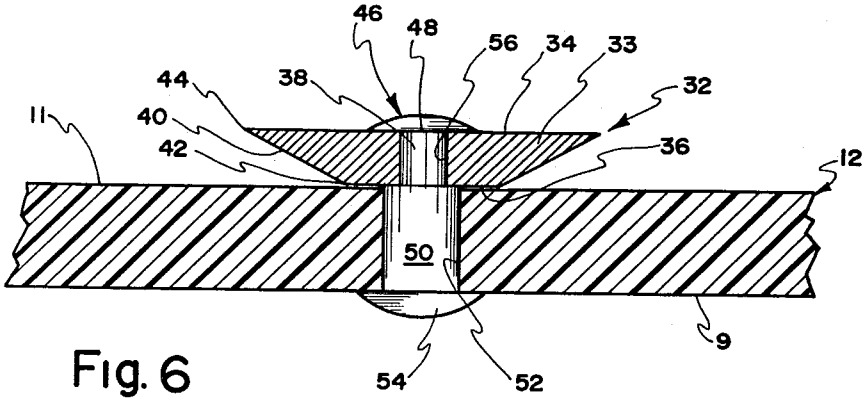
FIG. 6 is a fragmentary cross section taken along line 6—6 of FIG. 1.

The cutting wheel 33 comprises an exposed flat surface 34, terminating in a circumferential cutting edge 44. A tapered surface 40 projects inwardly away from the cutting edge 44 at an angle to the surface 34 and merges with a lower flat surface 36 at shoulder 42. The central and symetrical aperture 56 in the cutting wheel 33 fits loosely upon the recess 38 of the rivet to accommodate the mentioned wheel rotation. The plane containing the cutting edge 44 is illustrated in FIG. 6 as being parallel to the plane of the body 12. Also, as best illustrated in FIG. 1, the cutting wheel 33 is located so that the cutting edge 44 is just slightly inside of the circular site 30 assumed by a can whose lid is to be interiorly circumferentially severed by the wheel 33. The cutting location of the cutting wheel 33 is also illustrated in FIG. 7.

The can lid removing device 10, for purposes of retaining the can in the illustrated position during severence of the lid is provided with a pressure can-retaining elongated arm 60.

The arm 60 is illustrated as being relatively thin and of substantially uniform dimensions throughout (except for around the corners). The arm 60 is contained within a plane parallel to and immediately adjacent the plane of the body 12 and is mounted in cantilever fashion so as to be rotatable about the proximal end 61 by appropriately applying force to the distal end 63.

Figure 4:
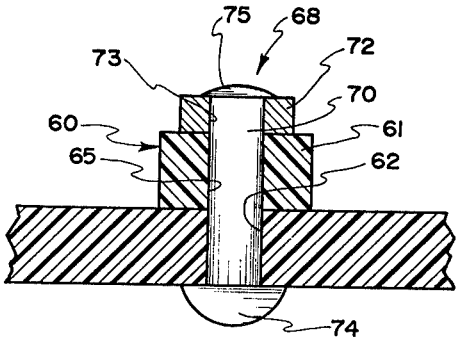
FIG. 4 is a fragmentary cross section taken along line 4—4 of FIG. 1.
Figure 5:
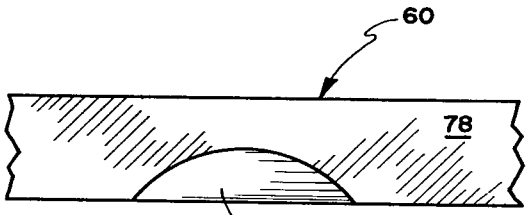
FIG. 5 is a fragmentary elevation taken along line 5—5 of FIG. 1.

More specifically, with particular reference to FIG. 4, the proximal end 61 of the arm 60 comprises a centrally disposed aperture 65 aligned with a similarly sized aperture 62 disposed in the body 12. A rivet 68 or other suitable fastener, having a uniform central diameter 70 extends through both aligned apertures 62 and 65 and is secured by opposed enlarged heads 74 and 75 in such a fashion that the arm 60 may be manually caused to be rotated about the center line of the rivet shaft 70. A washer or spacer 72, having an aperture 73 therein (through which the shaft 70 also passes), is interposed between the arm 70 and the head 75 to accommodate the mentioned rotation.

The arm 60 further comprises, along edge 78, an arcuate slot 76 which is sized, shaped, configurated and located so as to snugly receive part of the seam at 24 of the can when the can end is superimposed upon site 30 and the arm is rotated in the direction of arrow 79 (FIG. 1) so as to be immediately juxtaposed the cutting wheel 33. This position is illustrated in FIG. 7, the arm 60 thus being substantially parallel to the adjacent edge of the body 12 and held in position by force 81.

In use, pressure applying can retaining arm 60 is pivoted out of the way and a can from which a lid is to be removed is rectilinearly advanced from the side into the can opener 10 and caused to be wedged between the concavities 18 of the stop members 14 and 15. Thus, the can is contiguously superimposed upon site 30 (FIG. 1). The pressure applying arm 60 is manually rotated into tight contiguous relation with the adjacent seam 24 of the can and there retained by force 81, thereby causing the concavity 76 of the arm to snugly grip part of the mentioned can seam. This force 81 also causes the cutting edge 44 of the cutting wheel 33 to penetrate the can lid along the interior circumference thereof at site 58 (FIG. 7).

At this point the can may be held stationary and the device turned or vice versa through one or more full rotations ample to entirely cut the interior circumference of the lid through 360°. Orientation of the cutting wheel in a plane parallel to the plane of the lid will correspondingly severe the lid from the remainder of the can in such a fashion so as to leave no sharp edges, burrs, or the like. Accordingly, the remainder of the can may be utilized as a drinking vessel or the like. Also, both ends of the can may be removed and the can flattened, if desired, although the device works best on aluminum cans which have one lid only.

During periods of non-use, the can opener can readily accommodate storage in one's pocket, purse, or the like.

Figure 8:
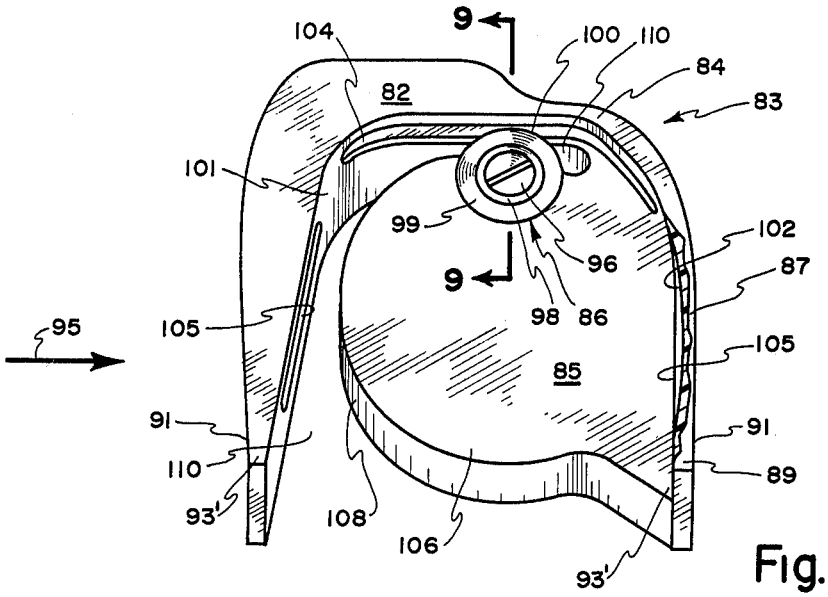
FIG. 8 is an elevated perspective view of a second presently preferred can opener embodiment according to the present invention.

FIG. 8 illustrates a second presently preferred can opener embodiment of the present invention, generally designated 83. Can opener 83 comprises a generally flat one piece main body 85, which is generally circular in plane view with an integral wrap around pressure arm 82. Arm 82 is attached to the remainder of the can opener at a yieldable proximal integral hinge end 84 thereof and surrounds almost half of the circular main body 85 while remaining separate from said body (in an unstressed state) by space 110. Yieldable clamp arm 82 terminates in a distal end 93, which is tangentially disposed in respect to the adjacent circular circumference 108 of body 85 to accommodate can ingress and egress. The pressure arm 82 and a ridge 87 are of greater thickness than the main body 85.

The arm 82 and the ridge 87 are thus effectively caused to surround approximately 270° of the end of a can (the lid of which is desired to be removed) when the can is properly inserted upon the cutting side of body 85. Ridge 87 is in effect a continuation of the arm 82 past the hinge 84, but is rigidly connected to the body 85. Ridge 87 terminates in a small straight tail 89, which creates a generally triangular area 93' of the main body 80 to accommodate ingress and egress of the end of the can.

The can opening device 83 is preferably constructed of one piece of suitable plastic material with memory. Accordingly, by manually applying force in the general direction of arrow 95, the arm 82 is caused to rotate about the neck or hinge 84 to become contiguous with or nearly contiguous with the adjacent surface 108 of body 85 for purposes and in a manner as hereinafter more fully described.

Figure 9:
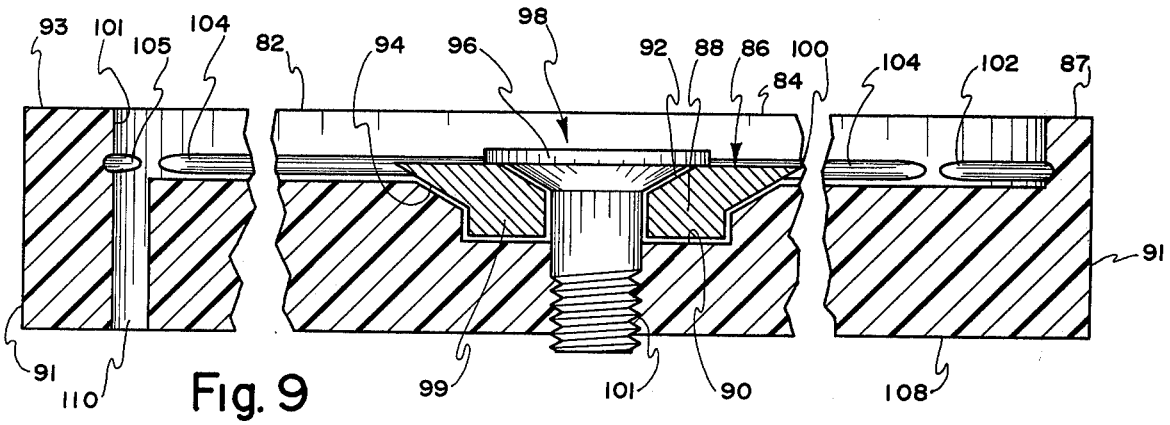
FIG. 9 is a fragmentary cross section taken along line 9—9 of FIG. 8, illustrating a circular cutting wheel of the can opener.

Disposed upon main body 85 near neck 84 is a circular cutting wheel assembly 86. Cutting wheel assembly 86 comprises a circular cutting wheel 99 comprised of an annular shank 88 which fits down into a counterbored circular recess 90 in the body 85. The cutting wheel 99 also comprises a top counterbored aperture 92 which receives a flat headed screw 98. Screw 98 is threadedly received and secured in a threaded aperture disposed in the body 85 at the base of the recess 90. Screw 98 thus rotatably secures the cutting wheel 99 to the body 85, as illustrated in FIG. 9.

Thus, the cutting edge 100 of the cutting wheel 99 is disposed at a slight angle to the plane of the adjacent surface of body 85. The mentioned angle aids in not only cutting the lid from the can in the fashion generally previously described, but exerts a progressive pry upon the lid being severed to aid in the lid removing process, the cutting edge 100 reaching its maximum elevation directly adjacent the arm 82.

A shoulder 105 is disposed between the body 85 and the ridge 87. A generally concaved groove 102 exists in the surface or shoulder 105, which groove 102 is sized, shaped and configurated to contigously receive part of the lip or seam 24 of one end of the can.

In like fashion, the surface 101 defines two spaced can lip-receiving grooves 104 and 105. The grooves 104 and 105 are shaped, sized, configurated, and located so that, together with groove 102, approximately 270° of the can lip 24 is securely retained, when the handle 82 is flexed inwardly under force 95.

If desired, the arm 82 may be flexed away from the body 85 to accommodate fascile insertion of the can and between the arm 82 and the cutting edge 100 of the cutting wheel 99, the flexing of the arm 82 occuring at integral hinge 84.

Thus, the use of can opener 83 is substantially similar to the use of previously described can opener 10 in that the can end 24 comprising the lid to be severed is inserted contiguous with the body 85 and caused to be contiguous with the grooves 102, 104, and 105 by flexing of the handle 82 inwardly to clamp and rotatably retain the can, following which either the device 83 or the can is rotated until the lid is severed in the manner previously described. During periods of non-use, the device 83 may be conveniently stored in one's pocket, purse or elsewhere, and, being relatively planar or flat, little space is consumed during storage. Thus, the device is highly portable.

Figure 10:
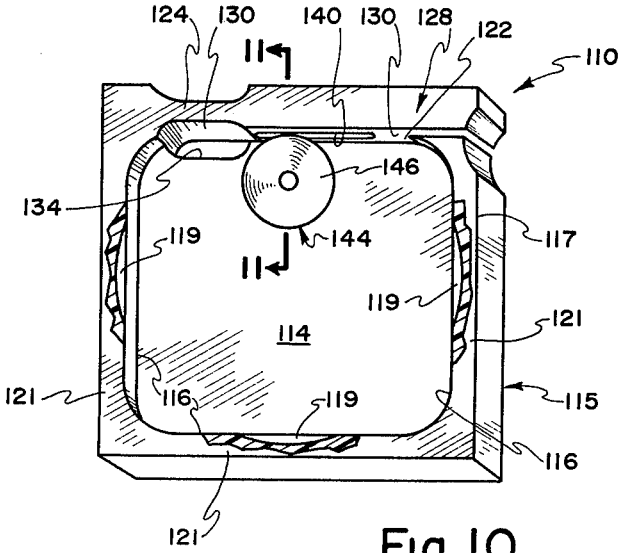
FIG. 10 is an elevated perspective view of a third presently preferred can opener embodiment according to the present invention.

The third presently preferred can opener embodiment, generally designated 110, is illustrated in FIG. 10. The can opener 110 is generally flat and displays a somewhat retangular exterior periphery. The can opener 110 comprises a main body portion 115 and a two way flexible arm 128, attached to the main body 115 at integral hinge 124 but otherwise separated from the body 115 (in the unstressed condition) by space 122.

The body 115 comprises a central recess 114, which is surrounded by three elevated sides which comprise ridges 121. A shoulder 116 connects the body 114 to each ridge 121. Along each of the three legs of shoulder 116 is provided an arcuate contoured recess 119 each of which is sized, located and configurated to receive part of the lip or seam 24 of a can the lid of which is desired to be severed using the device 110. The interior surface 130 of the yieldable arm 128 is also provided with an arcuate contoured groove or slot 140 likewise sized, shaped, and located to receive and retain the seam or lip of the can when the arm 128 is flexed inwardly. The arm 128 is flexed away from the recess 114 when it is desired to insert a can end into the opener 110.

Once the can is inserted as described, the device 110 is typically held in the palm of one hand and the device squeezed so as to cause the handle 128 to rotate about the hinge 124 thereby firmly but rotatably clamping the end of the can in the inserted position. By relative rotation of the device 110 and the can, the cutting wheel 144 at the cutting edge 146 is caused to cut the lid from the can, as heretofore described. The cutting wheel 144 may comprise any satisfactorily cutting wheel assembly and may be rotatably mounted to the body 115 at recess 114 in any suitable fashion so as to be centrally juxtaposed the central slot 140 in the cantilever arm 128.

To remove the can after severence of the lid, the arm 128 is pivoted away from the body 115 and the can removed in a direction substantially perpendicular to the plane containing the surface 114. The device 110 is also highly portable and compact. It may be conveniently stored in one's pocket, purse or elsewhere.

This invention may be embodied in other specific forms without departing from the spirit or essential characteristics thereof. The present embodiments are therefore to be considered in all respects as illustravtive and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A non-extensible, non-retractable portable can lid removing device having fixed pivotable features only comprising:

flat body means, manual bias applying clamp means and an eccentric pivot site relatively pivotably uniting the flat body means and the manual bias applying clamp means;

the flat body means comprising an essentially circular region having an area substantially equal to the area of a can of predetermined diameter adapted to be received at said circular region having a plurality of non-rotatable abutment means along a fixed radius co-axial with said essentially circular region adapted to contiguously slidably engage a portion of the top edge of the bead at the one end of the can;

the clamp means comprising pivotable non-extensible lever means by which the clamp means are relatively displaced pivotably inwardly between an open position and a second closed position, the clamp means also comprising non-rotatable abutment means slidably engaging the outside portion of the bead in the closed position along the periphery of the circular region, the engaging means being remote from the eccentric pivot site;

lid cutting means carried directly adjacent the flat body means in such a position as to have its cutting edge superimposed upon the periphery of said circular region to cut the lid from the can upon adequate relatively manual rotation of the can and the device when one end of the can is correctly positioned over the circular region and the clamp means of the device are in the closed position.

2. A portable can lid removing device according to claim 1 wherein the flat body means comprise a planar base and the receiving means comprise opposed relatively shallow static stops shaped to contiguously, releasably and relatively rotatably receive the outside portion of the bead at the one can end.

3. A portable can lid removing device according to claim 1 wherein the receiving means of the flat body means comprise a planar recessed area surrounded in part by a shoulder at least one portion of which is contoured to receive part of the outside portion of the bead at said one end of the can.

4. A portable can lid removing device according to claim 1 wherein the clamp means comprise at least one non-extensible pivotable arm pivotably connected at one pivot site only to the body means, the arm having recess means remote from the pivot site comprising the engaging means of the means, the arm being contoured to contiguously engage part of the outside portion of the bead at the one can end.

5. A portable can lid removing device according to claim 4 wherein the pivotable arm is at least partly superimposed and at least partly pivotable across the body means.

6. A portable can lid removing device according to claim 4 wherein the pivotable arm is disposed adjacent the edge of the body means in the open position and is displaced toward the body means to obtain the closed position.

7. A portable can lid removing device according to claim 4 wherein the pivotable non-extensible connector means comprises a pin fastener.

8. A portable can lid removing device according to claim 4 wherein the pivotable non-extensible connector means comprises an integral hinge.

9. A portable can lid removing device according to claim 1 wherein the lid cutting means comprise a cutting wheel rotatably secured to the body means and located to sever the can lid along the inside circumference thereof when the can end is in the second position and the can and device are sufficiently relatively rotated.

* * * * *